US008065992B2

(12) United States Patent
Tschaler et al.

(10) Patent No.: US 8,065,992 B2
(45) Date of Patent: Nov. 29, 2011

(54) VALVE ARRANGEMENT FOR AN EXHAUST GAS RECIRCULATION DEVICE

(75) Inventors: Gernot Tschaler, St. Valentin (AT); Andreas Nabecker, St. Georgen (AT)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 12/831,670

(22) Filed: Jul. 7, 2010

(65) Prior Publication Data

US 2011/0023838 A1 Feb. 3, 2011

Related U.S. Application Data

(63) Continuation of application No. PCT/EP2008/010496, filed on Dec. 11, 2008.

(30) Foreign Application Priority Data

Jan. 22, 2008 (DE) ..... 10 2008 005 591

(51) Int. Cl.
*F02M 25/07* (2006.01)
*F02B 47/08* (2006.01)

(52) U.S. Cl. ..... 123/568.12; 123/568.2; 123/568.23

(58) Field of Classification Search ..... 123/568.11, 123/568.12, 568.17–568.21, 568.23–568.28; 701/108; 60/605.2
See application file for complete search history.

(56) References Cited

U.S. PATENT DOCUMENTS

| | | | | |
|---|---|---|---|---|
| 5,617,726 | A * | 4/1997 | Sheridan et al. | 60/605.2 |
| 7,163,005 | B2 * | 1/2007 | Tussing et al. | 123/568.12 |
| 7,168,250 | B2 * | 1/2007 | Wei et al. | 60/605.2 |
| 7,661,415 | B2 * | 2/2010 | Nakamura | 123/568.12 |
| 7,757,679 | B2 * | 7/2010 | Joergl et al. | 123/568.12 |
| 7,845,338 | B2 * | 12/2010 | Smith et al. | 123/568.12 |
| 2003/0000497 | A1 | 1/2003 | Brosseau et al. | |
| 2005/0241702 | A1 | 11/2005 | Blomquist et al. | |
| 2007/0017489 | A1 | 1/2007 | Kuroki et al. | |
| 2009/0056683 | A1 * | 3/2009 | Joergl et al. | 123/568.19 |

FOREIGN PATENT DOCUMENTS

| | | | |
|---|---|---|---|
| DE | 197 33 964 | A1 | 2/1999 |
| DE | 100 25 877 | A1 | 12/2001 |
| DE | 102 21 711 | A1 | 11/2003 |
| DE | 10 2006 000 348 | A1 | 2/2007 |

(Continued)

OTHER PUBLICATIONS

German Search Report dated Nov. 25, 2008 with partial English translation (nine (9) pages).

(Continued)

*Primary Examiner* — Willis Wolfe, Jr.

(74) *Attorney, Agent, or Firm* — Crowell & Moring LLP

(57) ABSTRACT

A valve arrangement is provided for an exhaust gas recirculation device of an internal-combustion engine. The engine has at least one inlet and at least one outlet. The recirculation device includes an inlet on the internal-combustion engine outlet side, an outlet on the internal-combustion engine inlet side, and several, particularly two flow paths extending between the inlet and the outlet and being parallel at least in areas. The valve arrangement has a first control element and a second control element for automatically regulating/controlling fluid flow flowing between the inlet and the outlet and automatically regulating/controlling the distribution of this fluid flow between the several flow paths. A common actuator is provided for operating the first control element as well as the second control element.

17 Claims, 12 Drawing Sheets

FOREIGN PATENT DOCUMENTS

| | | | |
|---|---|---|---|
| EP | 0 900 930 | A2 | 3/1999 |
| EP | 1 103 715 | A1 | 5/2001 |
| EP | 1 378 855 | A2 | 1/2004 |
| EP | 1 555 421 | A2 | 7/2005 |

OTHER PUBLICATIONS

International Search Report dated Mar. 23, 2009 with English translation (six (6) pages).

* cited by examiner

VALVE ARRANGEMENT FOR AN EXHAUST GAS RECIRCULATION DEVICE

CROSS-REFERENCE TO RELATED APPLICATIONS

This application is a continuation of PCT International Application No. PCT/EP2008/010496, filed Dec. 11, 2008, which claims priority under 35 U.S.C. §119 from German Patent Application No. DE 10 2008 005 591.3, filed Jan. 22, 2008, the entire disclosures of which are herein expressly incorporated by reference.

BACKGROUND AND SUMMARY OF THE INVENTION

The invention relates to a valve arrangement for an exhaust gas recirculation device of an internal-combustion engine with at least one inlet and at least one outlet, having an inlet on the internal-combustion engine outlet side, an outlet on the internal-combustion engine inlet side, and several, particularly two, flow paths extending between the inlet and the outlet and being parallel at least in areas. The valve arrangement has a first control element and a second control element for automatically regulating/controlling the fluid flow flowing between the inlet and the outlet and automatically regulating/controlling the distribution of this fluid flow between the several flow paths.

The exhaust gas recirculation (AGR) is a measure for reducing nitrogen oxide (NOx) particularly in the case of internal-combustion engines and is significant mainly in the case of lean-operation internal-combustion engines. In this case, a partial exhaust gas flow will be admixed again in an automatically regulated/controlled manner to the internal-combustion engine on the intake side by way of a flow duct via an exhaust gas recirculation valve.

The admixing of fuel gas can take place in front of or into the combustion chamber. The resulting mixture of fuel gas and exhaust gas has a lower useful heat value relative to the volume and therefore no longer reaches the temperature in the combustion chamber of the internal-combustion engine that is required for the formation of NOx. The exhaust gas recirculation normally takes place in the partial load range.

An improved NOx reduction can be achieved when the exhaust gas is cooled before the admixing to the fuel gas. This cooling takes place particularly in the case of higher-power engines, in which case an exhaust gas recirculation cooler is used. Further advantages are achieved when not only the recirculated exhaust gas flow as a whole but also its cooling can be automatically regulated/controlled.

From German patent document DE 10 2006 000 348 A1, an arrangement for the recirculation of exhaust gas is known which has an inlet on the side of the internal-combustion engine outlet, an outlet on the side of the internal-combustion engine inlet, and two parallel flow paths extending between the inlet and the outlet. One flow path includes an exhaust gas recirculation cooler, while the other flow path forms a bypass for bypassing the exhaust gas recirculation cooler. For automatically regulating/controlling the entire exhaust gas flow flowing between the inlet and the outlet, an exhaust gas recirculation valve is provided; an automatic regulating/controlling of the distribution of the recirculated exhaust gas between the two flow paths and thus of the cooling takes place by way of a cooling valve.

In this case, it is a disadvantage that, in addition to the two valve control elements, also the corresponding periphery, in particular including actuators, additional outputs at an internal-combustion engine control unit, cable harness taps, is required.

It is therefore an object of the invention to provide a valve arrangement of the concerned type, in which particularly an additional actuator, additional outputs on an internal-combustion engine control unit, and cable harness taps, can be eliminated. Such an arrangement should require only little space and be distinguished by a good tightness of the control elements in the closed condition and by high flow rates when the control elements are maximally opened.

This object is achieved by a valve arrangement for an exhaust gas recirculation device of an internal-combustion engine including at least one inlet and at least one outlet, having an inlet on the internal-combustion engine outlet side, an outlet on the internal-combustion engine inlet side, and several, particularly two, flow paths extending between the inlet and the outlet and being parallel at least in areas. The valve arrangement has a first control element and a second control element for automatically regulating/controlling the fluid flow flowing between the inlet and the outlet and automatically regulating/controlling the distribution of this fluid flow between the several flow paths. According to the invention, a common actuator is provided for actuating the first control element as well as the second control element.

The actuator can preferably be adjusted between a first actuator end position and a second actuator end position. An actuator starting position is provided which is situated between the first and the second actuator end position, particularly at least approximately in the center between the first actuator end position and the second actuator end position. In this case, starting from the actuator starting position, an actuation is made possible in the direction of the first actuator end position and in the direction of the second actuator end position.

During an actuation starting from the actuator starting position in the direction of the first or the second actuator end position, it is particularly advantageous for the first control element and the second control element to be actuated successively and/or simultaneously. Here, an actuation of the first and of the second control element can take place in different fashions. Likewise, it is advantageous, during an actuation starting from the actuator starting position in the direction of the first actuator end position, to actuate only the first control element or only the second control element, and during an actuation in the direction of the second actuator end position, to actuate only the respectively other control element. Also, an actuation of only the first control element during an actuation starting from the actuator starting position in the direction of the first or the second actuator end position offers special advantages.

The first control element and/or the second control element are expediently acted upon by spring force in the closing direction, so that by way of the actuator an actuation takes place in the opening direction, and in the closing direction the first and/or the second control element follows the actuator in a manner acted-upon by spring force. By way of this arrangement, a fail-safe function is also ensured. Likewise, it is considered to be useful for the first control element and/or the second control element to be restrictedly guided in the opening and in the closing direction. In this case, the closing force does not depend on the force of a spring, but is also applied by the actuator and the corresponding control element follows the actuator not only in a force-locking but also in a form-locking manner.

According to a particularly preferred embodiment of the invention, a first transmission device is provided between the actuator and the first control element, and a second transmission device is provided between the actuator and the second control element. The transmission devices are used for converting the actuator movement into a movement of the control elements, and in each case permit transmission ratio profiles especially adapted to the requirements.

In the case of a valve arrangement in which the actuator is a rotary drive, preferably the first transmission device and/or the second transmission device is suitable for converting a rotatory movement to a linear movement.

It is very advantageous for the first transmission device and/or the second transmission device to have at least one gate and at least one driving device interacting with the latter. In this context, a "gate" is also an element driving a driving device, even though no or at least no significant relative movement takes place between the driving device and this element.

It was found to be particularly useful that, by way of the second transmission device, a discontinuous movement transmission is achieved between the actuator and the second control element, so that the second control element will not always be actuated when the actuator is operated.

It is also advantageous for the first transmission device and/or the second transmission device to have a toothing with an input and an output toothing.

According to a particularly preferred embodiment of the invention of the valve arrangement, the second control element is acted upon by spring force in a bistable manner in the direction of an opening or a closing position. The second control element is therefore acted upon by a force in the direction of the opening or closing position, in which case, for example, during actuation starting from the opening position, first an actuation takes place against the (decreasingly effective) spring force; then a neutral dead center is reached in which the spring force is not active in the opening or closing direction, and then, as a result of the spring force, a "snapping over" takes place in the direction of the closing position. In the reverse direction, the bistable control element will act correspondingly.

By means of the actuator and the second transmission device, the second control element can expediently be displaced in a dead-center-overriding manner between the opening position or a closing position.

The second transmission device preferably includes transmission elements having play and a force-type connection which changes as a function of the actuating direction, so that a hysteresis is achieved. When the dead center is exceeded, an actuation of the second control element is therefore obtained caused by the spring force while passing through the play, independently of an actuator movement. During an opening movement, a correlation of movements between the actuator and the control element exists that is different than during a closing movement.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
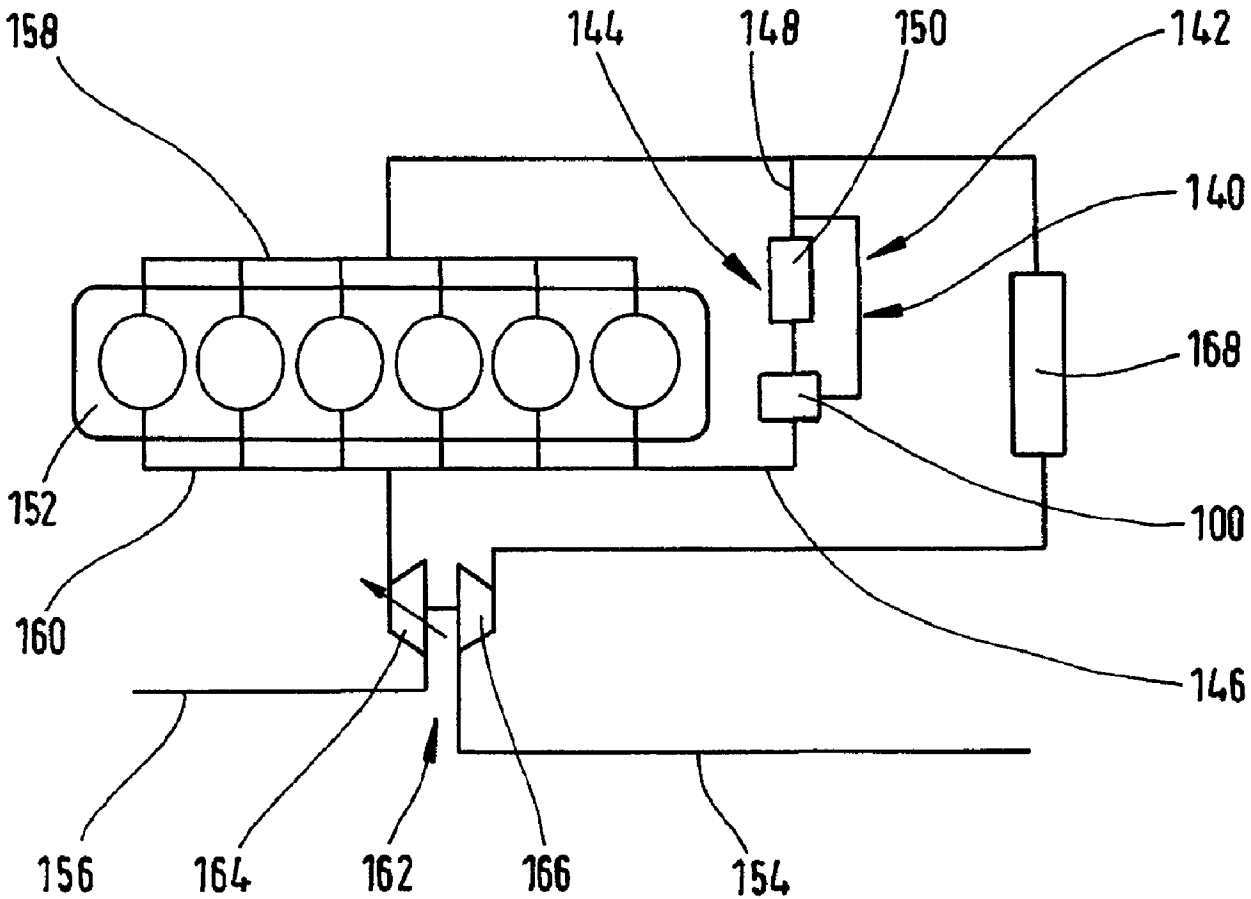
FIG. 1 is a schematic view of an example of a motor vehicle internal-combustion engine having a fuel gas inlet, an exhaust gas outlet and an exhaust gas recirculation device with an exhaust gas recirculation cooler and a bypass.

FIG. 1 illustrates a motor vehicle internal-combustion engine 152 having a fuel gas inlet, an exhaust gas outlet and an exhaust gas recirculation device 140 with an exhaust gas recirculation cooler 150 and a bypass 142. In this case, a six-cylinder in-line internal-combustion engine is illustrated as an example of the internal-combustion engine 152. A fuel gas inlet pipe 154 leads into a fuel gas collector 158, starting from which the cylinders of the internal-combustion engine are supplied with fuel gas. By way of an exhaust gas manifold 160, the exhaust gases of the internal-combustion engine are fed to an exhaust gas outlet pipe 156. An exhaust gas turbocharger 162 is used for increasing the power and includes an exhaust-gas-driven turbine 164 and a fuel gas pump 166 positively connected with the latter for the charged filling of the cylinders of the internal-combustion engine with fuel gas. A charge air cooler 168 is provided for further increasing the power.

The exhaust gas recirculation device 140 has an inlet 146 on the internal-combustion engine outlet side, an outlet 148 on the internal-combustion engine inlet side and two parallel flow paths 142, 144 extending between the inlet 146 and the outlet 148. An exhaust gas recirculation cooler 150 for the power-increasing cooling of recirculated exhaust gas is arranged in the flow path 144. The flow path 142 parallel thereto forms a bypass with respect to the flow path 144 and is used for bypassing the exhaust gas recirculation cooler 150. By way of a valve arrangement 100, the entire recirculated exhaust gas flow flowing between the inlet 146 and the outlet 148, as well as its distribution between the two flow paths 142, 144 and thereby its cooling, can be automatically regulated/controlled. The valve arrangement 100 is preferably arranged in the branching area of the flow paths 142, 144. In the present case, the valve arrangement 100 is arranged in the inlet-side branching area; however, it may also be expedient to arrange the valve arrangement 100 in the outlet-side branching area.

Figure 2A:
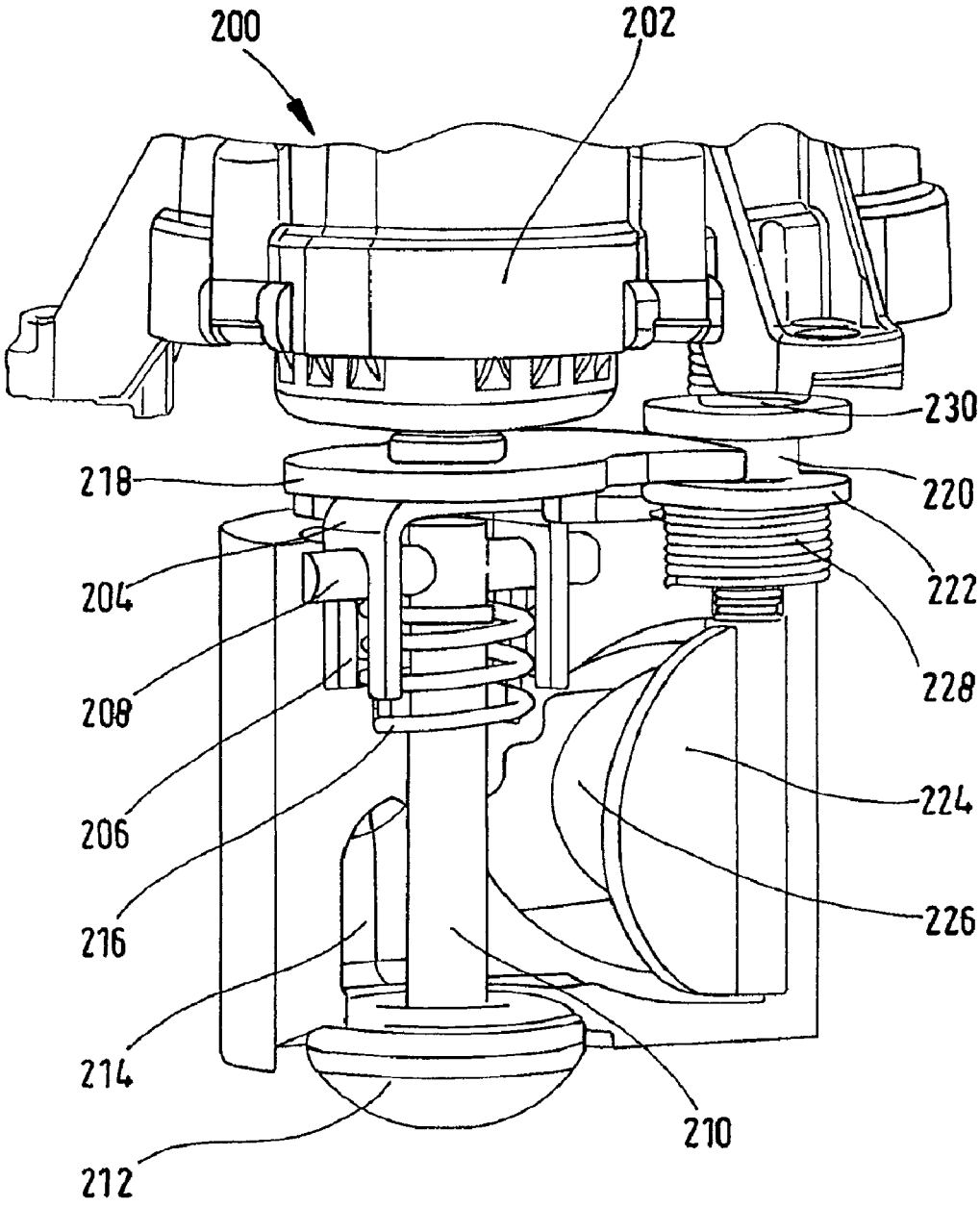
FIG. 2*a* is a schematic view of an example of a valve arrangement having an actuator, a lift valve and a flap valve, the lift valve being closed and the flap valve being open.
Figure 2C:
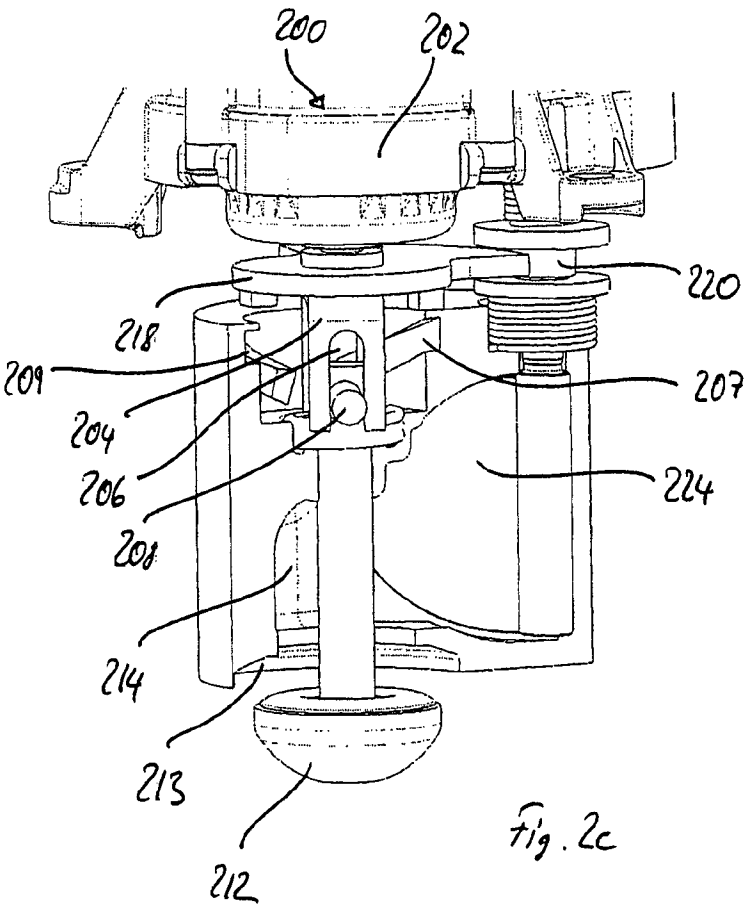
FIG. 2*c* is a schematic view of an example of a valve arrangement having an actuator, an lift valve and a flap valve, the lift valve being open and the flap valve being closed.
Figure 2B:
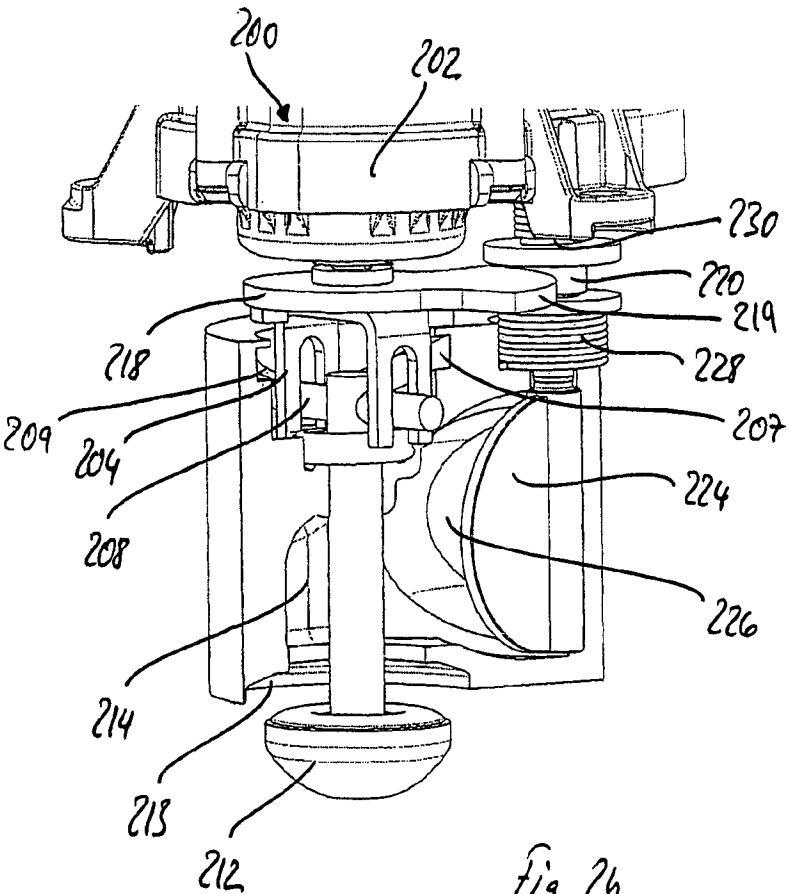
FIG. 2*b* is a schematic view of an example of a valve arrangement having an actuator, a lift valve and a flap valve, the lift valve being open and the flap valve being open.

FIG. 2*a* illustrates a valve arrangement 200 having an actuator 202, a lift valve 212 and a flap valve 224 in the case of an actuator position in which the lift valve 212 is closed and the flap valve 224 is open. An actuator position in which the lift valve 212 is open and the flap valve 224 is open is illustrated in FIG. 2*b*, and an actuator position in which the lift valve 212 is open and the flap valve 224 is closed is illustrated in FIG. 2*c*.

The lift valve 212 is used as an exhaust gas recirculation valve and permits an automatic regulation/control of the entire exhaust gas flow flowing between the inlet 214 and the outlet. The flap valve 224 is used as a cooling valve and permits an automatic regulation/control of the distribution of the recirculated exhaust gas flow between the cooling path and the bypass 226 (FIG. 1: 142, 144) and thus the cooling.

The actuator 202 is an electrical rotary drive; however, as required, a hydraulic or pneumatic drive may also be used. The actuator 202 is non-rotatably connected with a fork-type transmission element 204. The transmission element 204 has longitudinal guides 206 extending in the axial direction of the lift valve.

Pins 208 that are rectangular with respect to the axial direction of the lift valve are guided in the longitudinal guides 206, the ends of the pins 208 being guided in the valve-body-side spiral gates 207, 209. The pins 208 are fixedly connected with a rotatable shaft 210 of the lift valve 212. By means of a spring 216, the lift valve 212 can be acted upon by force in the closing direction.

During a rotation of the actuator 202 in the opening direction of the lift valve, the transmission element 204 is rotated correspondingly and takes along the pins 208 by means of the longitudinal guides 206. In this case, the pins 208 are moved along the gates 207, 209, and the lift valve 212 opens against the force of the spring 216 by lifting off the valve-body-side valve seat 213.

Figure 7:
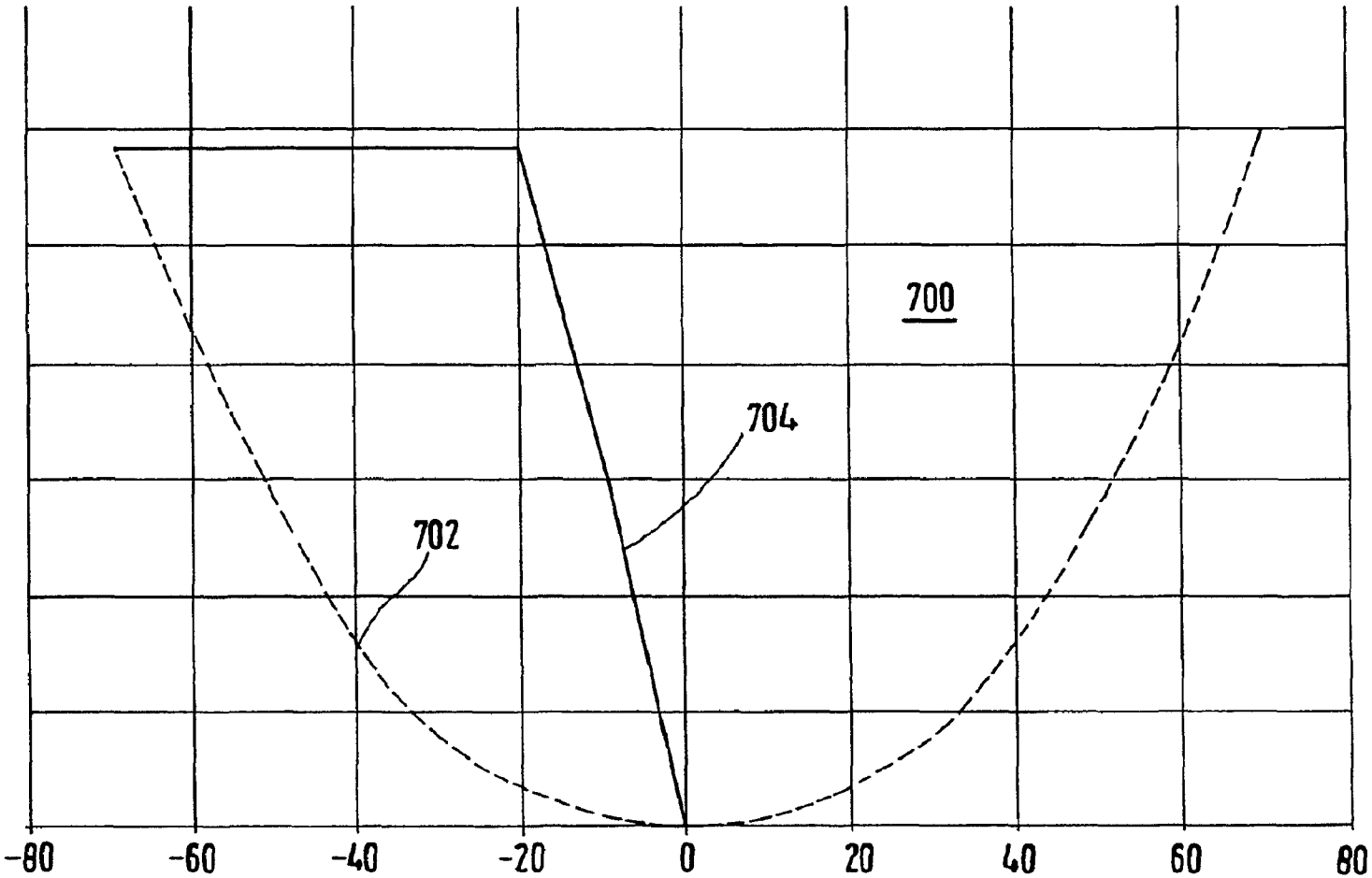
FIG. 7 is a diagram for positioning the control elements with respect to the actuator position in the case of a valve arrangement according to FIGS. 2*a*-2*c;*

The movement pattern of the lift valve 212 as a function of the rotating movement of the actuator 202 is illustrated in the diagram 700 in FIG. 7. In this figure, the actuator angles of −80° to +80° are plotted on the X-axis. An actuator starting position is situated at 0° between an actuator end position in the case of a positive actuator angle and an actuator end position in the case of a negative actuator angle. A broken line 702 shows the movement pattern of the lift valve 212 as a function of the rotating movement of the actuator 202. In the actuator starting position at an actuator angle of 0°, the lift valve 212 is closed. The lift valve 212 opens when the actuator is operated in the direction of positive or negative actuator angles. The opening function is symmetrical relative to the actuator starting position in the direction of positive and negative actuator angles and, on the whole, as an approximately parabola-type shape.

In addition, the actuator 202 is non-rotatably connected with a further transmission element 218, which has a toothing, in this case, a toothed segment 219. A toothed gear element 220 corresponds with this toothing, which toothed gear element 220 itself interacts with a transmission element 222 connected with a shaft of the flap valve 224. The flap valve 224 is acted upon by force in the closing direction by means of a spring 228. A spring 230 is used for the corresponding action upon the toothed gear element 220.

During a rotation of the actuator 202 in the direction of a negative actuator angle (FIG. 7), the toothed segment 219 is also rotating and drives the corresponding toothed gear element 220. The toothed gear element 220 takes along the transmission element 222 connected with the shaft of the flap valve 224 and the flap valve 224 opens against the force of the spring 228.

The movement pattern of the flap valve 224 as a function of the rotating movement of the actuator 202 is also illustrated in the diagram of FIG. 7. A line 704 shows the movement pattern of the flap valve 224 as a function of the rotating movement of the actuator 202. The flap valve 224 is closed in the actuator starting position at an actuator angle of 0°. When the actuator is operated in the direction of the negative actuator angle, the flap valve 224 will open. In this case, the opening function at first corresponds to an at least approximately continuously rising straight line, in which case, at an actuator angle of approximately 20°, a maximal opening of the flap valve 224 will be achieved. During a further operation of the actuator 202, the flap valve 224 will not open wider; the further rotation of the toothed gear element 220 takes place against the spring 230 without taking along the transmission element 222. When the actuator is operated in the direction of the positive actuator angle, the flap valve will remain closed. In this operating direction, the transmission element 222 will not be taken along.

Starting from the actuator starting position at 0°, the lift valve 212 as well as the flap valve 224 is therefore opened in the direction of the negative actuator angle, so that the recirculated exhaust gas flow will be guided past the exhaust gas recirculation cooler through the bypass 226. Only the lift valve 212 will be opened in the direction of the positive actuator angle, so that the recirculated exhaust gas flow is guided through the flow path having the exhaust gas recirculation cooler (FIG. 1: 144, 150).

Figure 3:
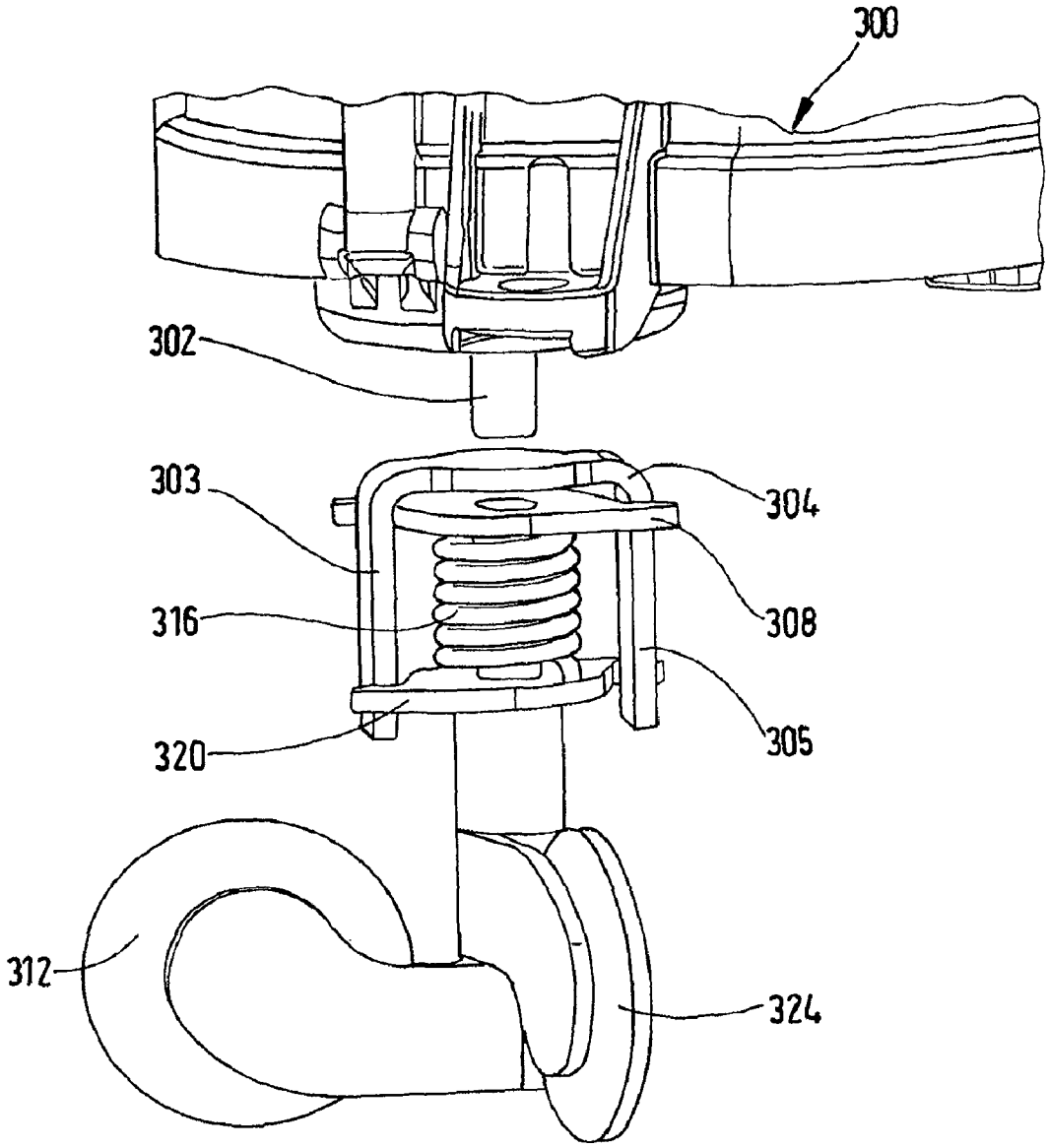
FIG. 3 is a schematic view of an example of a valve arrangement having an actuator and two mushroom valves.

FIG. 3 shows a valve arrangement 300 having one actuator 302 and two mushroom valves 312, 324. In the present case, the mushroom valve 312 is assigned to the flow path having the exhaust gas recirculation cooler (FIG. 1: 144, 150), and the mushroom valve 324 is assigned to the bypass (FIG. 1: 142). Each mushroom valve 312, 324 makes it possible to automatically regulate/control the exhaust gas flow flowing through the respective flow path (FIG. 1: 142, 144).

The actuator 302 is an electrical rotary drive; however, as required, a hydraulic or pneumatic drive may also be used. The actuator 302 is non-rotatably connected with a fork-type transmission element 304. The two ends 303, 305 of the transmission element 304 are used as a "gate" for taking along the driving devices 308 or 320. The driving device 308 is assigned to the mushroom valve 312; the driving device 320 is assigned to the mushroom valve 324. Both mushroom valves 312, 324 are acted upon by force in the closing direction by a spring 316. The spring 316 supports itself on the driving device 308 on the one side and on the driving device 320 on the other side and thus acts upon both driving devices.

Figure 8:
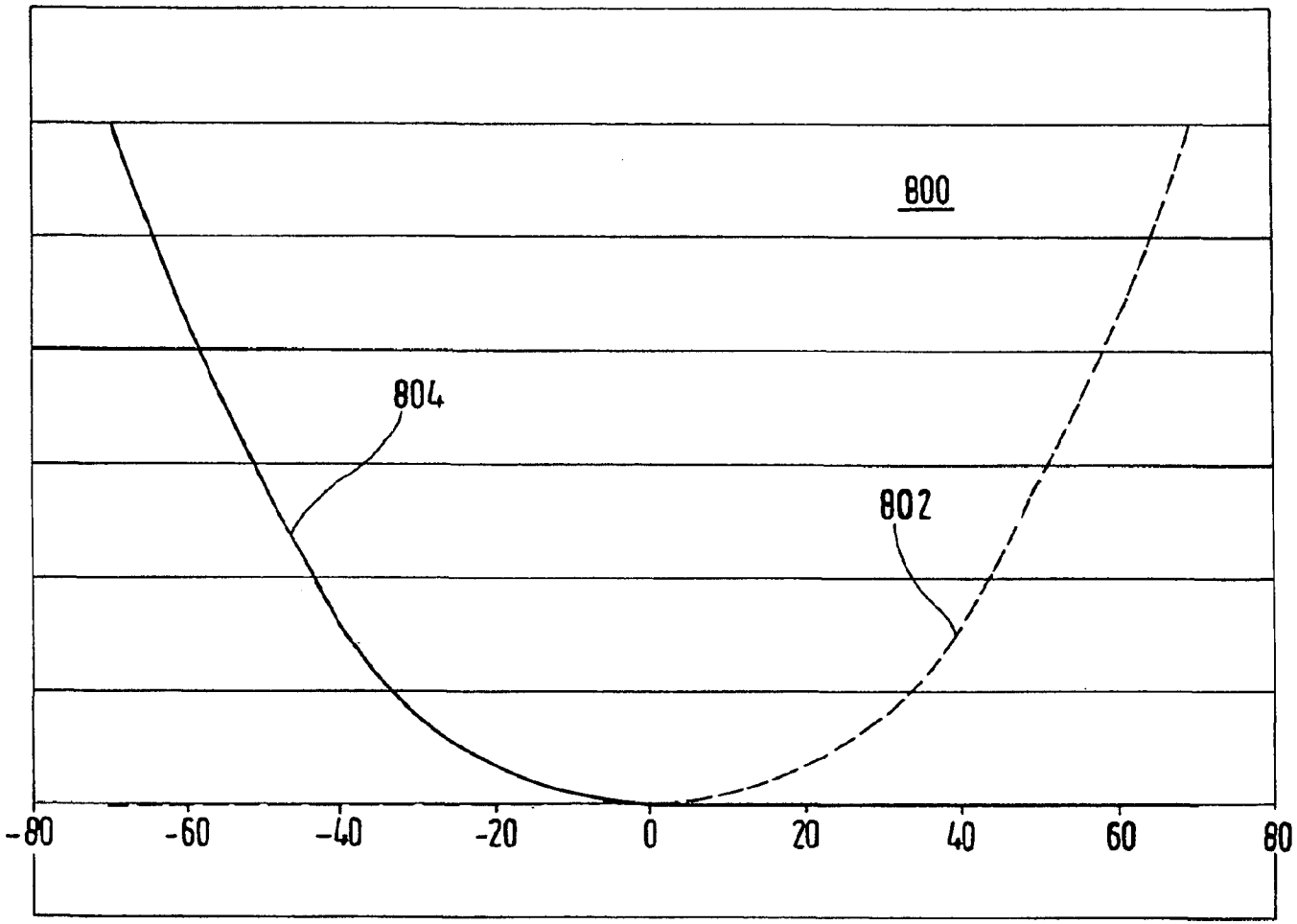
FIG. 8 is a diagram for positioning the control elements with respect to the actuator position in the case of valve arrangements according to FIGS. 3-5.

The movement pattern of the mushroom valves 312, 324 as a function of the rotating movement of the actuator 302 is illustrated in the diagram 800 in FIG. 8. In FIG. 8, the actuator angles of −80° to +80° are plotted on the X-axis. At 0°, an actuator starting position is situated between an actuator end position in the case of a positive actuator angle and an actuator end position in the case of a negative actuator angle.

A broken line 802 indicates the movement pattern of the mushroom valve 312 as a function of the rotating movement of the actuator 302. In the actuator starting position at an actuator angle of 0°, the mushroom valve 312 is closed. When the actuator is operated in the direction of positive actuator angles, the mushroom valve 312 will open while the mushroom valve 324 will remain closed in that the two ends 303, 305 of the transmission element 304 take along the driving device 308. Starting from the actuator starting position at 0°, the mushroom valve 312 is therefore opened in the direction of positive actuator angles, while the mushroom valve 324 remains closed so that only the flow path having the exhaust gas recirculation cooler (FIG. 1: 144, 150) will be opened.

A line 804 shows the movement pattern of the mushroom valve 324 as a function of the rotating movement of the actuator 302. In the actuator starting position at an actuator angle of 0°, the mushroom valve 324 is closed. When the actuator is operated in the direction of negative actuator angles, the mushroom valve 324 will open while the mushroom valve 312 will remain closed in that the two ends 303, 305 of the transmission element 304 take along the driving device 320. Starting from the actuator starting position at 0°, the mushroom valve 324 is therefore opened in the direction of negative actuator angles, while the mushroom valve 312 remains closed so that only the bypass (FIG. 1: 142) will be opened.

The branch of the opening curve 802 in the direction of positive actuator angles and the branch of the opening curve 804 in the direction of negative actuator angles, together, relative to the actuator starting position, have an approximately parabola-type shape.

Figure 4A:
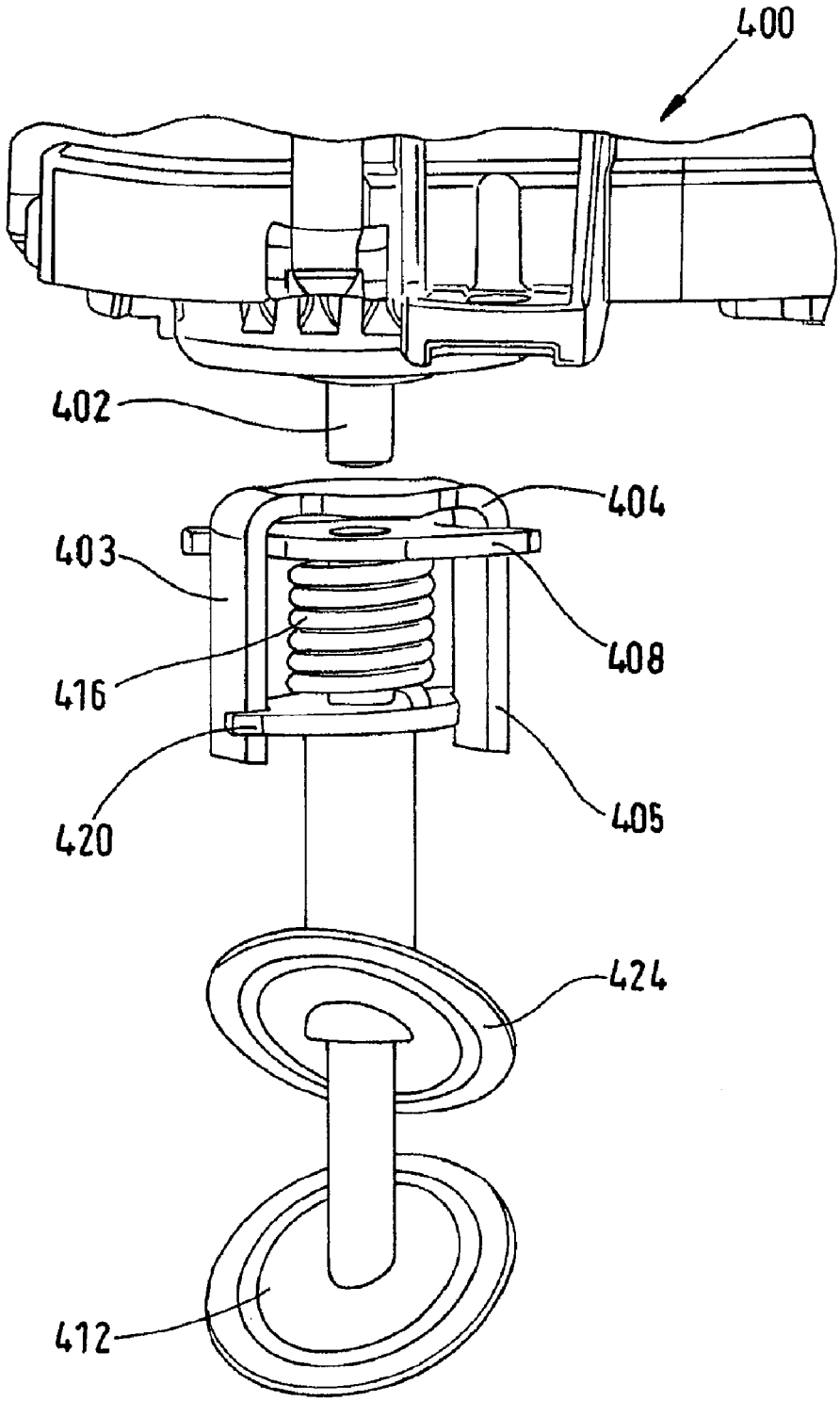
FIG. 4*a* is a schematic view of an example of a valve arrangement having an actuator and two rotary mushroom valves.
Figure 4C:
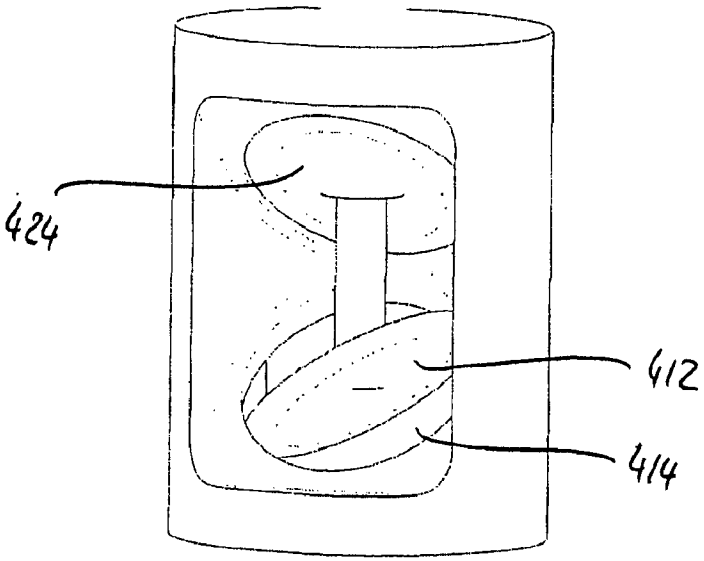
FIG. 4*c* is a schematic view of an example of a valve arrangement having an actuator and two rotary mushroom valves, the first rotary mushroom valve being open and the second rotary mushroom valve being closed.
Figure 4B:
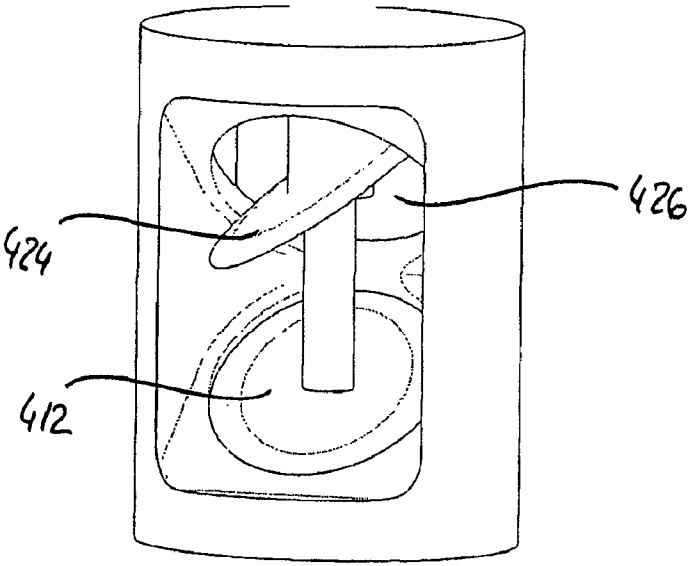
FIG. 4*b* is a schematic view of an example of a valve arrangement having an actuator and two rotary mushroom valves, the first rotary mushroom valve being closed and the second rotary mushroom valve being open.

FIG. 4*a* illustrates a valve arrangement 400 having one actuator 402 and two rotary mushroom valves 412, 424. An actuator position in which the rotary mushroom valve 412 is closed and the rotary mushroom valve 424 is opened is illustrated in FIG. 4*b*, and an actuator position in which the rotary mushroom valve 412 is opened and the rotary mushroom valve 424 is closed is illustrated in FIG. 4*c*. In the present case, the rotary mushroom valve 412 is assigned to the flow path 414 having an exhaust gas recirculation cooler (FIG. 1: 144, 150), and the rotary mushroom valve 424 is assigned to the bypass 426 (FIG. 1: 142). Each rotary mushroom valve 412, 424 makes it possible to automatically regulate/control the exhaust gas flow flowing through the respective flow path (FIG. 1: 142, 144).

The actuator 402 is an electrical rotary drive; however, as required, a hydraulic or pneumatic drive may also be used. The actuator 402 is non-rotatably connected with a fork-type transmission element 404. The two ends 403, 405 of the transmission element 404 are used as a "gate" for taking along the driving devices 408 or 420. The driving device 408 is assigned to the rotary mushroom valve 412; the driving device 420 is assigned to the rotary mushroom valve 424. Both rotary mushroom valves 412, 424 are acted upon by force in the closing direction by way of a spring 416, the spring 416 supporting itself on the driving device 408 on the one side and on the driving device 420 on the other side and thus acting upon both driving devices.

The movement pattern of the rotary mushroom valves 412, 424 as a function of the rotating movement of the actuator 402 is illustrated in the diagram 800 in FIG. 8 and corresponds to that of the valve arrangement 300, the curve 802 showing the course of the opening of the rotary mushroom valve 412, and the curve 804 showing the course of the opening of the rotary mushroom valve 424.

Figure 5:
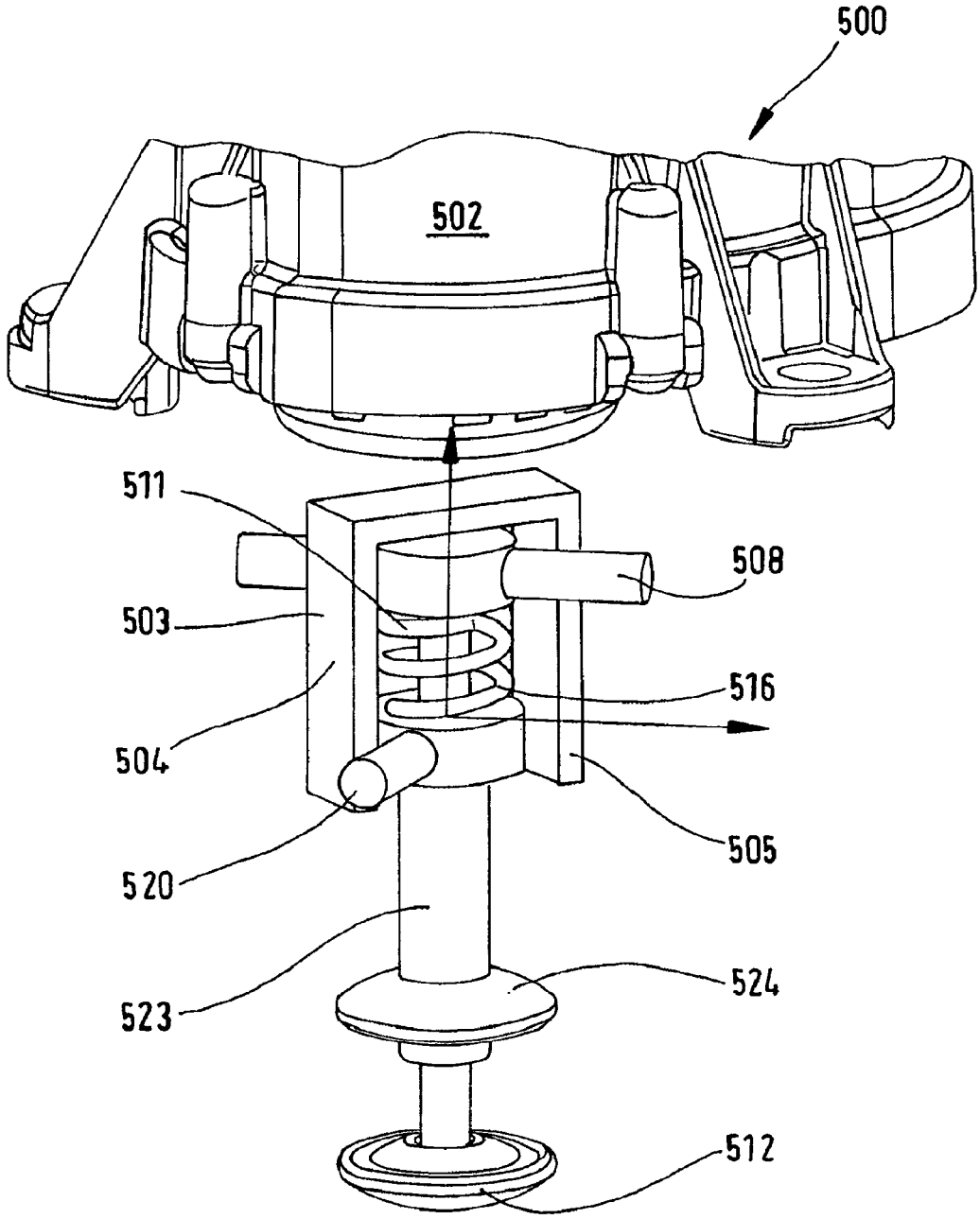
FIG. 5 is a schematic view of an example of a valve arrangement having an actuator and two lift valves.

FIG. 5 shows a valve arrangement 500 having an actuator 502 and two lift valves 512, 524. In the present case, the lift valve 512 is assigned to the flow path having the exhaust gas recirculation cooler (FIG. 1: 144, 150), and the lift valve 524 is assigned to the bypass (FIG. 1: 142). Each lift valve 512, 524 makes it possible to automatically regulate/control the exhaust gas flow flowing through the respective flow path (FIG. 1: 142, 144).

The actuator 502 is an electrical rotary drive; however, as required, a hydraulic or pneumatic drive may also be used. The actuator 502 is non-rotatably connected with a fork-type transmission element 504. The two ends 503, 505 of the transmission element 504 are used as a "gate" for taking along pin-shaped driving devices 508 or 520 that are rectangular with respect to the axial direction of the lift valve, the ends of the driving devices 508 or 520 being guided in spiral gates (not shown) on the side of the valve body. The driving devices 508, 520 are fixedly connected with the rotatable shafts 511, 523 of the lift valves 512, 524. By way of a spring 516, the lift valves 512, 524 are acted upon by force in the closing direction.

During rotation of the actuator 502, the transmission element 504 is rotated correspondingly and, as a function of the rotating direction, by means of the ends 503, 505 takes along either the driving device 508 or the driving device 520. In this case, the driving devices 508 or 520 are moved along the valve-body-side gates, and the respective lift valve 512 or 524 opens against the force of the spring 516 in that it lifts off a valve-body-side valve seat.

The movement pattern of the lift valves 512, 524 as a function of the rotating movement of the actuator 502 is illustrated in the diagram 800 in FIG. 8 and corresponds to that of the valve arrangements 300 and 400, the curve 802 showing the course of the opening of the lift valve 512, and the curve 804 showing the course of the opening of the lift valve 524.

Figure 6A:
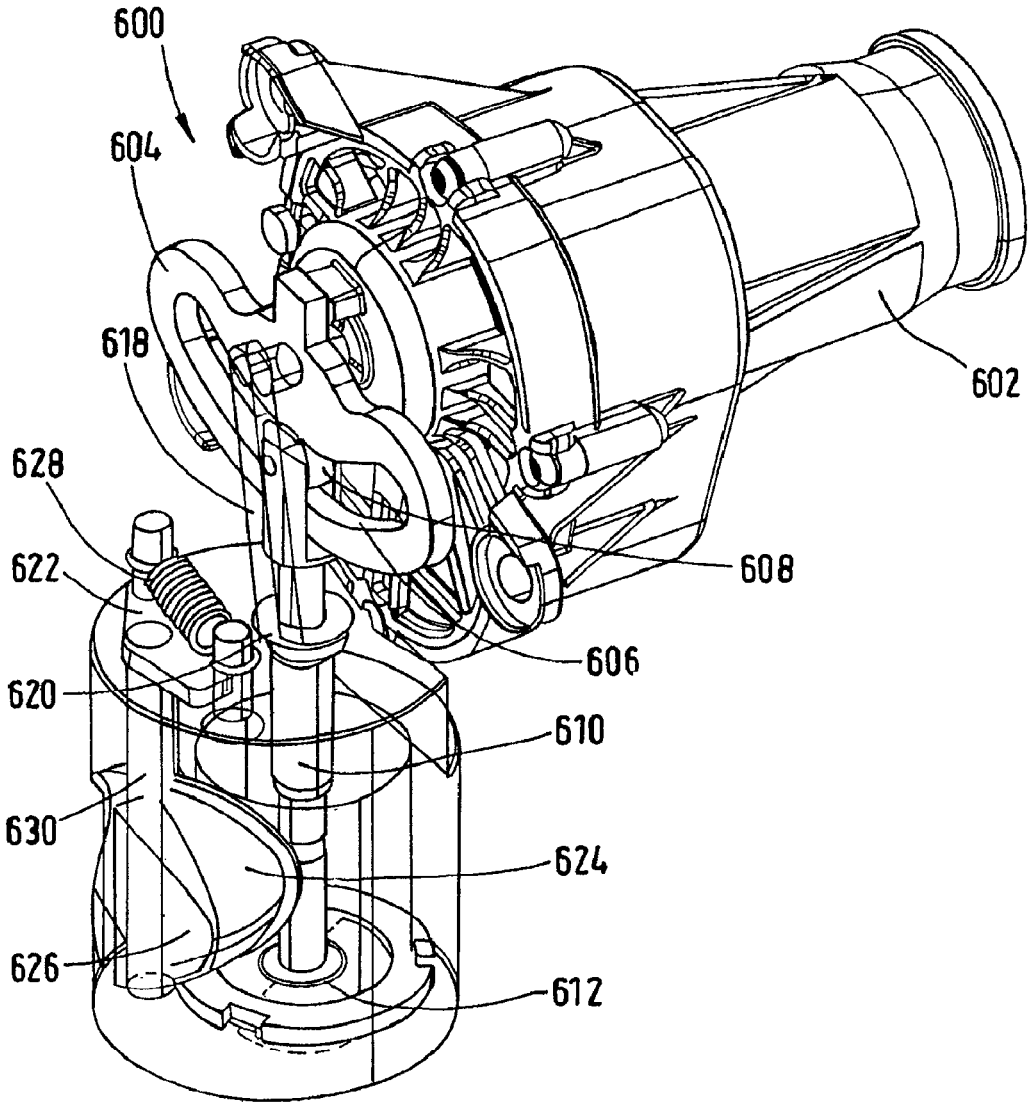
FIG. 6*a* is a schematic view of an example of a valve arrangement having an actuator, a lift valve and a bistable flap valve.
Figure 6D:
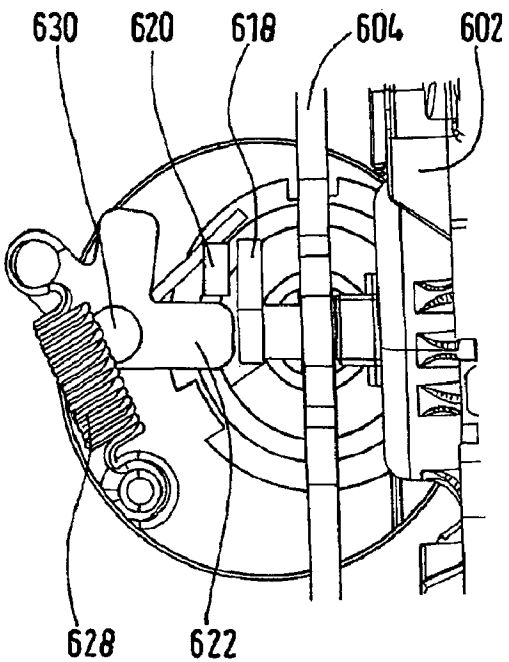
FIG. 6*d* is a schematic view of an example of a valve arrangement having an actuator, a lift valve and a bistable flap valve, the flap valve being behind the dead center in the opening position.
Figure 6C:
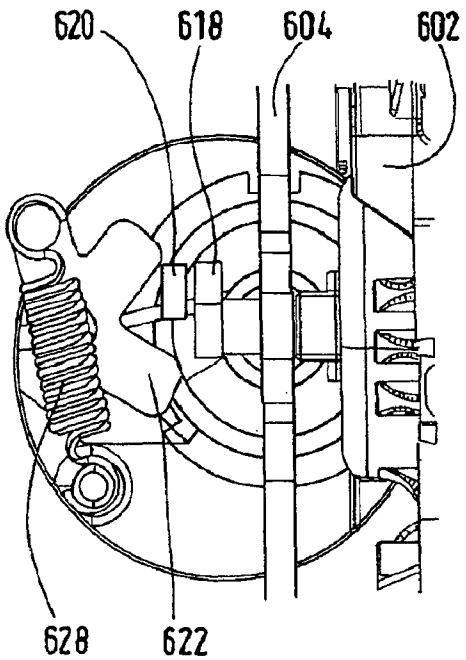
FIG. 6*c* is a schematic view of an example of a valve arrangement having an actuator, a lift valve and a bistable flap valve, the flap valve being in front of the dead center during an actuation in the direction of the opening position.
Figure 6B:
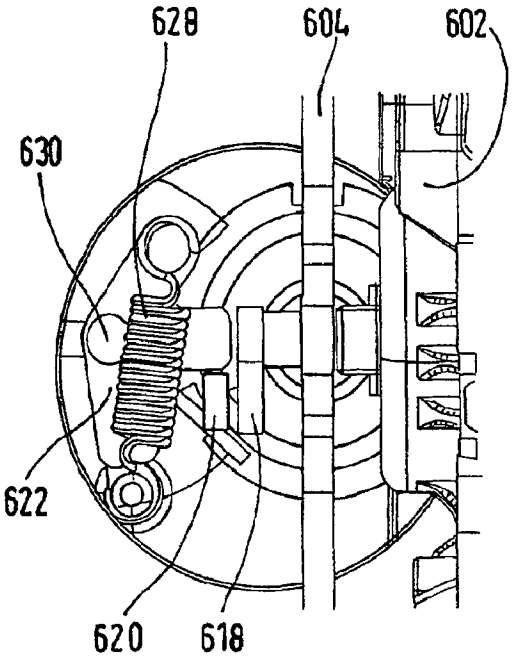
FIG. 6*b* is a schematic view of an example of a valve arrangement having an actuator, a lift valve and a bistable flap valve, the flap valve being in a closing position.

FIG. 6*a* shows a valve arrangement 600 having an actuator 602, a lift valve 612 and a bistable flap valve 624. The flap valve 624 in the closing position is illustrated in FIG. 6*b*; the flap valve 624 during the operation in the direction of the opening position in front of the dead center is illustrated in FIG. 6*c*, and the flap valve 624 in the opening position behind the dead center is illustrated in FIG. 6*d*.

The lift valve 612 is used as an exhaust gas recirculation valve and makes it possible to automatically regulate/control the entire exhaust gas flow flowing between the inlet and the outlet (FIG. 1: 146, 148). The flap valve 624 is used as a cooling valve and makes it possible to automatically regulate/control the distribution of the recirculated exhaust gas flow between the cooling path and the bypass 626 (FIG. 1: 142, 144) and thus the cooling.

The actuator 602 is an electrical rotary drive; however, as required, a hydraulic or pneumatic drive may also be used. The actuator 602 is non-rotatably connected with a transmission element 604 having a curved, particularly a circular-arc-shaped, gate 606. The gate 606 is spaced away from the actuator axis, has a minimal distance from the actuator axis in its center and has an increasing distance from the actuator axis in the direction of its ends. A driving device 608, which is connected with the shaft 610 of the lift valve 612, is guided in the gate 606. In the present case, the driving device 608 is a roller rotatably disposed on the shaft 610 of the lift valve 612. In a manner surrounded on two sides, this roller is guided in the gate 606 and, when the actuator is operated, rolls on the gate-side surface of the transmission element 604. The actuator axis is situated at least approximately at a right angle with respect to the axis of the lift valve 612.

During rotation of the actuator 602 in the lift valve opening direction, the transmission element 604 is correspondingly rotated and, by means of the curved gate, takes along the driving device 608. In this case, the lift valve 612 is opened against the force of a closing spring.

Figure 9:
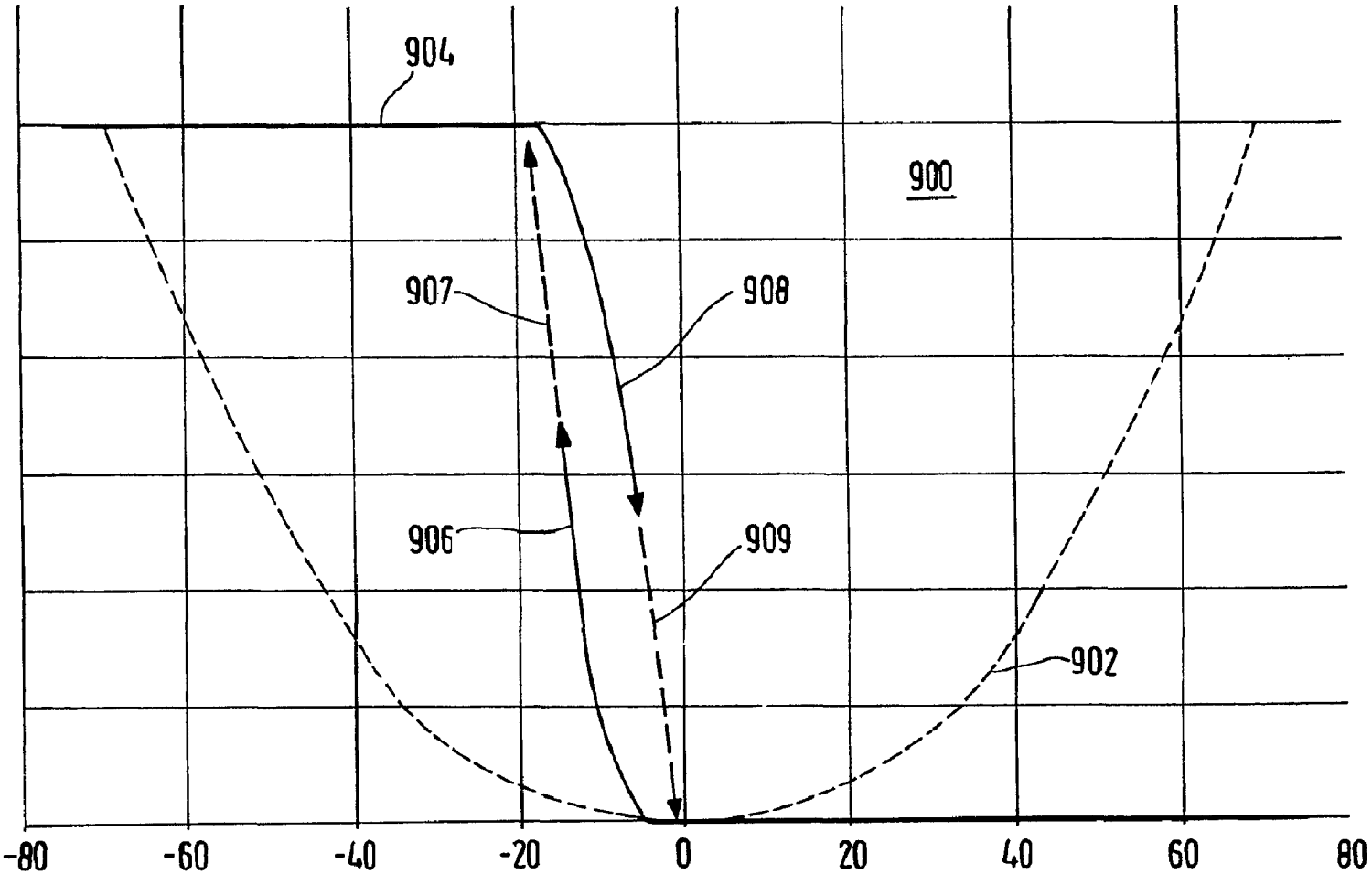
FIG. 9 is a diagram for positioning the control elements with respect to the actuator position in the case of a valve arrangement according to FIGS. 6*a*-6*d.*

The movement pattern of the lift valve 612 as a function of the rotating movement of the actuator 602 is illustrated in the diagram 900 in FIG. 9. In this figure, the actuator angles of −80° to +80° are plotted on the X-axis. At 0°, an actuator starting position is situated between an actuator end position in the case of a positive actuator angle and an actuator end position in the case of a negative actuator angle. A broken line 902 shows the movement pattern of the lift valve 612 as a function of the rotating movement of the actuator 602. The lift valve 612 is closed in the actuator starting position at an actuator angle of 0°. The lift valve 612 will open when the actuator is operated in the direction of positive or negative actuator angles. In this case, the opening function is symmetrical relative to the actuator starting position in the direction of positive and negative actuator angles and, as a whole, has an approximately parabola-type shape.

In addition, the actuator 602 is non-rotatably connected with another, pointer-type transmission element 618. The actuator-side end of this transmission element 618 is connected with the actuator axis; the other end has a driving device 620. This driving device 620 corresponds with a transmission element 622 which can be swiveled about an axis at least approximately parallel to the shaft 610 of the lift valve 612 and at least approximately rectangular with respect to the actuator axis. The swiveling axis of the transmission element 622 simultaneously forms a shaft 630 of the flap valve 624 with which the transmission element 622 is non-rotatably connected.

The transmission element 622 has two mutually angular arms which enclose a recess in which the driving device 620 is accommodated. The driving device 618 is received with play in the recess of the transmission element 622. A third arm of the transmission element 622 is used for receiving a spring 628 which, on the other side, is supported at the valve body. The transmission element 622 can be swiveled between two end positions which correspond to an open and a closed position of the flap valve 624.

In these two end positions, illustrated in FIGS. 6*b* and 6*d*, the axis of the shaft 630 is situated maximally away from the axis of the spring 628, whereby the spring 628 exercises a maximal tension force component upon the transmission element 622 in the rotating direction in the direction of the respective end position. The closer the axis of the shaft 630 comes to the axis of the spring 630 during an operation, the lower the spring force component acting upon the transmission element 622 in the rotating direction in the direction of the end position. When the axis of the shaft 630 coincides with the axis of the spring 628, no spring force component will act upon the transmission element 622 in the rotating direction in the direction of the end position. This position is called the "dead center".

During an operation of the actuator 602, the transmission element 618 and therefore the driving device 620 will swivel. The driving device 620 operates the transmission element 622 and therefore the flap valve 624.

The movement pattern of the flap valve 624 as a function of the rotating movement of the actuator 602 is also illustrated in the diagram 900 in FIG. 9. A line 904 illustrates the movement pattern of the flap valve 624 as a function of the rotating movement of the actuator 602. The flap valve 624 is closed in the actuator starting position at an actuator angle of 0°. The flap valve 624 opens when the actuator is operated in the direction of negative actuator angles. In this case, in an area 906, the opening function at first corresponds to a steeply rising parabola branch. In this operating range up to an actuator angle of approximately 15°, the transmission element 622 is swiveled in the flap valve opening direction by way of the driving device 620. When the dead center is exceeded, a further swiveling of the transmission element 622 caused by the force of the spring 628 takes place, in which case the transmission element 622 "snaps over" the dead center position and the contact between the transmission element 622 and the driving device 620 is temporarily released. In this section 907, the opening function corresponds at least approximately to a straight line, in which case, at an actuator angle of 10-30°, particularly at about 18°, a maximal opening of the flap valve 624 will be achieved. A further operation of the actuator in the opening direction will no longer influence the flap valve 624; it will remain maximally open.

Likewise, the flap valve 624 is closed when the actuator is operated starting from the actuator end position in the case of a negative actuator angle in the direction of the actuator starting position. In this case, in an area 908, the closing function at first corresponds to a steeply descending parabola branch. In this operating range extending to an actuator angle of approximately 5°, the transmission element 622 is swiveled by means of the driving device 620 into the flap valve closing direction.

When the dead center is exceeded, a further swiveling of the transmission element 622 caused by the force of the spring 628 takes place, in which case the transmission element 622 "snaps over" the dead center position and the contact between the transmission element 622 and the driving device 620 is temporarily released. In this section 909, the closing function corresponds at least approximately to a straight line. Caused by the accommodation of the driving device 620 with play in the recess of the transmission element 622, a correlation occurs between the actuator angle and the position of the flap valve 624 that is different than during a closing movement; a hysteresis is achieved.

When the actuator is operated in the direction of positive actuator angles, the flap valve 624 remains closed. No taking-along of the transmission element 622 takes place in this operating direction.

Starting from the actuator starting position at 0°, the lift valve 612, as well as the flap valve 624 is therefore opened in the direction of negative actuator angles, so that the recirculated exhaust gas flow is guided through the bypass 626 past the exhaust gas recirculation cooler. In the direction of positive actuator angles, only the lift valve is opened 612, so that the recirculated exhaust gas flow is guided through the flow path having the exhaust gas recirculation cooler (FIG. 1: 144, 150).

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A valve arrangement for an exhaust gas recirculation device of an internal-combustion engine, the exhaust gas recirculation device having an inlet on an outlet side of the internal-combustion engine, an outlet on an inlet side of the internal-combustion engine, and at least two flow paths extending between the inlet and the outlet, which two flow paths are arranged in parallel at least in areas, the valve arrangement comprising:

a first control element;

a second control element, the first and second control elements automatically regulating/controlling fluid flow between the inlet and the outlet as well as a distribution of the fluid flow between the at least two flow paths;

a common actuator operatively configured to operate both the first control element and the second control element;

a first transmission device operatively arranged between the actuator and the first control element; and a second transmission device operatively arranged between the actuator and the second control element, wherein at least one of the first transmission device and the second transmission device comprises a toothing.

2. A valve arrangement for an exhaust gas recirculation device of an internal-combustion engine, the exhaust gas recirculation device having an inlet on an outlet side of the internal-combustion engine, an outlet on an inlet side of the internal-combustion engine, and at least two flow paths extending between the inlet and the outlet, which two flow paths are arranged in parallel at least in areas, the valve arrangement comprising:

a first control element;

a second control element, the first and second control elements automatically regulating/controlling fluid flow between the inlet and the outlet as well as a distribution of the fluid flow between the at least two flow paths; and a common actuator operatively configured to operate both the first control element and the second control element, wherein the second control element is acted upon by a spring force in a bistable manner in a direction of an opening or closing position.

3. A valve arrangement for an exhaust gas recirculation device of an internal-combustion engine, the exhaust gas recirculation device having an inlet on an outlet side of the internal-combustion engine, an outlet on an inlet side of the internal-combustion engine, and at least two flow paths extending between the inlet and the outlet, which two flow paths are arranged in parallel at least in areas, the valve arrangement comprising:

a first control element;

a second control element, the first and second control elements automatically regulating/controlling fluid flow between the inlet and the outlet as well as a distribution of the fluid flow between the at least two flow paths;

a common actuator operatively configured to operate both the first control element and the second control element, wherein the actuator is a rotary drive; and a transmission element operatively arranged between the actuator and the first control element and the second control element, wherein the transmission element is operatively configured for converting a rotary movement of the actuator to movement of the first control element and the second control element.

4. The valve arrangement according to claim 3, wherein at least one of the first control element and the second control element are acted upon by a spring force in a closing direction.

5. The valve arrangement according to claim 3, wherein at least one of the first control element and the second control element are guided restrictedly in opening and closing directions.

6. The valve arrangement according to claim 3, wherein the actuator has a first actuator end position, a second actuator end position, and an actuator starting position situated between the first and second actuator end positions, the actuator operation occurring in a direction of the first actuator end position and in a direction of the second actuator end position.

7. The valve arrangement according to claim 6, wherein during an operation starting from the actuator starting position in a direction of the first or the second actuator end positions, the first and second control elements are operated at least one of successively and simultaneously.

8. The valve arrangement according to claim 6, wherein during an operation starting from the actuator starting position in a direction of the first actuator end position, only one of the first control element and second control element is operated, and, wherein during an operation in a direction of the second actuator end position, only the other respective control element is operated.

9. The valve arrangement according to claim 6, wherein during an operation starting from the actuator starting position in the direction of the first or the second actuator end position, only the first control element is operated.

10. The valve arrangement according to claim 3, wherein the transmission element further comprising:

a first transmission device operatively arranged between the actuator and the first control element; and a second transmission device operatively arranged between the actuator and the second control element.

11. The valve arrangement according to claim 10, wherein, via the second transmission device, a discontinuous movement transmission is obtained between the actuator and the second control element.

12. The valve arrangement according to claim 10, wherein at least one of the first transmission device and the second transmission device comprises a toothing.

13. The valve arrangement according to claim 10, wherein at least one of the first transmission device and the second transmission device comprises at least one gate and at least one driving device.

14. The valve arrangement according to claim 13, wherein, via the second transmission device, a discontinuous movement transmission is obtained between the actuator and the second control element.

15. The valve arrangement according to claim 10, wherein the second control element is acted upon by a spring force in a bistable manner in a direction of an opening or closing position.

16. The valve arrangement according to claim 15, wherein the second control element is displaceable between the opening or closing positions by the actuator and the second transmission device while passing over a dead center position.

17. The valve arrangement according to claim 16, wherein the second transmission device comprises transmission elements having play and a force-type connection, which connection changes as a function of an operating direction in order to achieve a hysteresis effect.

* * * * *